United States Patent [19]

Sperr, Jr.

[11] 3,992,690

[45] Nov. 16, 1976

[54] COMPOSITE ELECTROMAGNETIC COIL

[75] Inventor: Charles J. Sperr, Jr., Scottsdale, Ariz.

[73] Assignee: The Garrett Corporation, Los Angeles, Calif.

[22] Filed: Jan. 31, 1975

[21] Appl. No.: 546,065

[52] U.S. Cl. ..... 336/179; 335/299; 336/180; 336/222; 338/9

[51] Int. Cl.[2] ..... H01F 15/16

[58] Field of Search ..... 336/179, 222, 223, 180; 338/3, 7, 8, 9, 10; 323/45; 335/299

[56] References Cited

UNITED STATES PATENTS

| | | | |
|---|---|---|---|
| 1,972,319 | 9/1934 | Rypinski | 336/179 X |
| 2,082,121 | 6/1937 | Rypinski | 323/45 X |
| 3,378,763 | 4/1968 | Hastings | 336/179 X |
| Re 10944 | 7/1888 | Weston | 338/10 |

FOREIGN PATENTS OR APPLICATIONS

| | | | |
|---|---|---|---|
| 215,335 | 9/1925 | United Kingdom | 336/179 |

*Primary Examiner*—Thomas J. Kozma
*Attorney, Agent, or Firm*—Herschel C. Omohundro; James W. McFarland; Albert J. Miller

[57] ABSTRACT

This electromagnetic coil is composed of concentric multi-turn windings in magnetic aiding relationship, one winding being formed of copper wire and the other of wire made of copper contaminated with a minor percentage of a metal having a different coefficient of resistance than copper. The wires of both windings having a positive temperature coefficient of resistance, one being less than the other so that the power demands of the coil at low temperatures will be reduced with a minimum loss in hot ampere turns. The wire of copper contaminated with the other metal is of a smaller gage size and the thickness of the winding of such wire bears a predetermined ratio to the total of both windings whereby they will have substantially equal heat densities.

9 Claims, 8 Drawing Figures

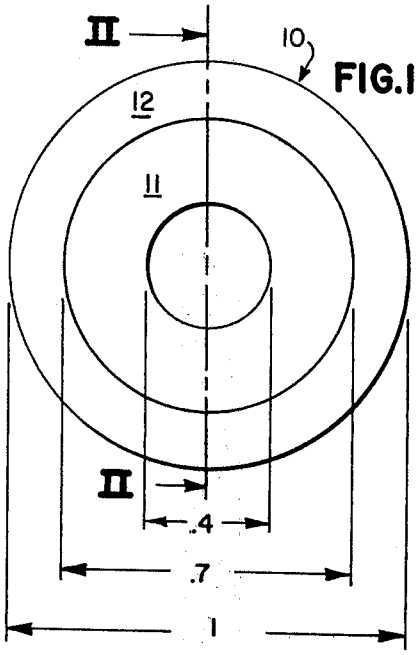

FIG.1.

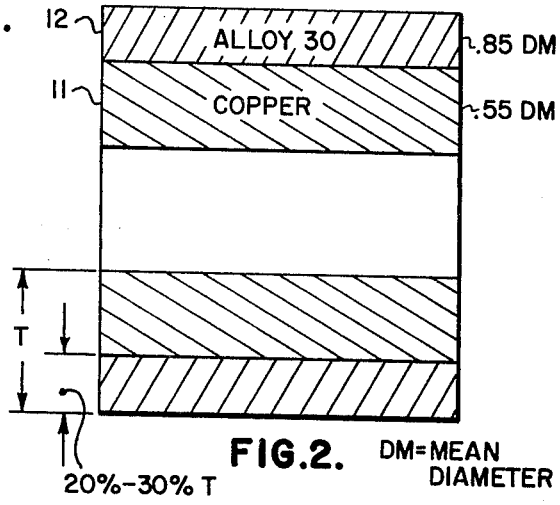

FIG.2. DM=MEAN DIAMETER

| WIRE TEMPERATURE F | SPECIFIC RESISTANCE OHMS / CMF | | RESISTANCE RATIO ALLOY 30 / COPPER |
|---|---|---|---|
| | ALLOY 30 | COPPER | |
| 68° | 30 | 10.37 | 2.89 |
| 480° | 39.4 | 19.7 | 2 |
| 800° | 47.3 | 26.9 | 1.76 |

FIG.3.

| | WIRE SIZE (AWG) | WIRE SECT. (CM) | TURNS (N) | AT 480° F | | AT −65° F | |
|---|---|---|---|---|---|---|---|
| | | | | RELATIVE OHMS/TURN | RELATIVE TOTAL OHM | RELATIVE TOTAL OHM | RELATIVE WATTS |
| COPPER | 30 | 100 | 100 | 1 | 100 | 37.4 | 1.0 |
| ALLOY 30 | 28.5 | 141 | 70.7 | 1.41 | 100 | 68.4 | 0.55 |

FIG.4.

RESISTANCE CHANGE(−65°F TO 480°)
COPPER = 2.672
ALLOY 30 = 1.462

| | WIRE SIZE (AWG) | WIRE SECT. (CM) | TURNS (N) | AT 480° F | | AT −65° F | |
|---|---|---|---|---|---|---|---|
| | | | | RELATIVE OHMS/TURN | RELATIVE OHMS/COIL | RELATIVE OHMS/COIL | RELATIVE WATTS |
| 1/2 COPPER 1/2 ALLOY 30 | 30 | 100 | 50 | $1 \times \frac{0.55}{0.7} = .786$ | 39.3 | 14.7 | BASED ON COPPER=37.4 |
| | 28.5 | 141 | 35.4 | $1.41 \times \frac{0.85}{0.7} = 1.712$ | 60.7 | 41.5 | (SEE FIG.4) |
| TOTAL COIL | | | 85.4 | | 100 | 56.2 | 0.67 |

FIG.5.

| COIL TYPE | NI AT 480° F | RELATIVE TOTAL OHMS | | RELATIVE WATTS AT −65°F |
|---|---|---|---|---|
| | | AT 480°F | AT −65°F | |
| ALL COPPER | 100 | 100 | 37.4 | 1.0 |
| 1/2 1/2 COPPER & ALLOY 30 | 85.4 | 100 | 56.2 | 0.67 |
| ALL ALLOY 30 | 70.7 | 100 | 68.4 | 0.55 |
FIG. 6.
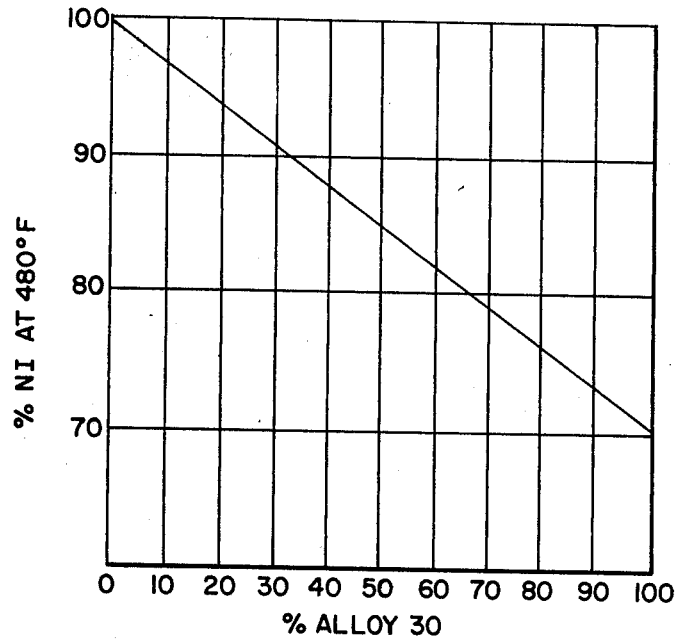
FIG. 7.
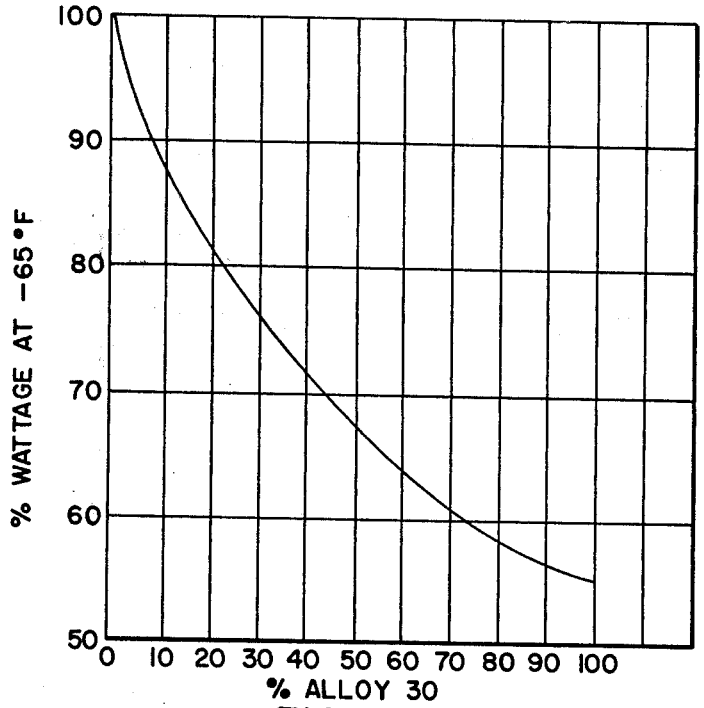
FIG. 8.

COMPOSITE ELECTROMAGNETIC COIL

BACKGROUND OF THE INVENTION

This invention relates generally to electrical devices and more particularly to devices using coils of wire arranged to develop magnetic forces, such, for example, as in solenoids or similar electrical elements. The field of endeavor to which the present invention generally relates is exemplified by patents:

Re No. 10,944 to Weston
Re No. 553,675 to Haskins
Re No. 928,136 to Lacy
Re No. 2,082,121 to Rypinski Each of these patents shows electrical devices having multiple coils arranged to receive electrical power and develop magnetic forces. In this respect the electromagnetic coil of the present invention is similar but the coil herein is intended for use in environments of widely varying temperatures, viz., −65° F to 450° F and in regions where space and weight are at a premium. Electromagnetic coils made from all copper wire have a radical change in resistance from cold to hot operating conditions, or vice versa. From 450° F to −65° F copper coil wattage requirements increase 260%, which is not compatible with present electronic power sources. While other types of coil wire, with less change in hot to cold resistance, are available, they have a much higher specific resistance than copper wire; therefore, coil designs embodying them adversely affect the electromagnetic performance of a coil limited to a predetermined envelope size, i.e., one composed entirely of all copper wire. The object of this invention is to provide an electromagnetic coil which will avoid the objections to coils constructed entirely of copper wire, as well as those constructed entirely of available alloys or other base metals.

It is also an object of the invention to provide an electromagnetic coil for effecting movement of a machine part such as the plunger of a valve. In many instances valves, or other electrically operated machine elements, are utilized in environments where extreme temperatures are encountered. At high altitudes, for example, temperatures as low as −65° F frequently occur. In other locations, such as adjacent to gas turbine or jet engines, temperatures as high or higher than 450° F are common. The provision of an electromagnetic coil which will operate without fail at such temperature extremes is a particular aim herein.

Also an object of the invention is to provide an electromagnetic coil which will operate at the previously mentioned temperature extremes without requiring excessive electrical power, insulation or package size.

Still another object of the invention is to provide an electromagnetic coil with multiple windings of wire having positive temperature coefficients of resistance, the coefficients of resistance in certain windings being different, whereby the resulting coil will be compatible with present electronic power sources.

A further object of the invention is to provide an electromagnetic coil of the character defined in the previous paragraph and in which the coil is composed of one winding of copper wire and at least one other winding of a wire with higher specific resistance/lower temperature coefficient whereby the change in hot to cold wattage will be significantly reduced with minimal impact on electromagnetic performance for a unit of predetermined size and weight.

A still further object of the invention is to provide an electromagnetic coil composed of an inner winding of copper wire and an outer winding of a wire made of copper contaminated with nickel or other suitable metal, on the order of 2%, the thicknesses of the inner and outer windings bearing a ratio between 80% to 20% and 70% to 30%.

It is an object also to provide an electromagnetic coil of the character specified in the preceding paragraph in which the outer winding is formed of wire one or two gage sizes smaller than the wire of the inner winding whereby substantially equal heat densities will exist in the windings.

Other objects and advantages will be made obvious by the following description of one embodiment of the invention selected for illustration in the accompanying drawing.

IN THE DRAWING

FIG. 1 is an end elevation of an electromagnetic coil formed in accordance with the present invention;

FIG. 2 is an axial sectional view taken through the coil of FIG. 1 on the plane indicated by the line II-II of such figure;

FIG. 3 is a table showing the comparative resistances at different temperatures of copper wire and a wire formed of an alloy of copper with a metal having a lower rate of resistance change with increase in temperature than copper, the alloy being designated as Alloy 30;

FIG. 4 is a chart showing a comparison of certain operating characteristics of an all copper coil and an all Alloy 30 coil of equal physical dimensions operating on the same voltage and dissipating the same wattage;

FIG. 5 is also a chart similar to FIG. 4 but showing the relationships of a composite coil composed of one half copper and one half Alloy 30;

FIG. 6 is a table summarizing the results of the charts shown in FIGS. 4 and 5; and FIGS. 7 and 8 are graphs with curves plotted to show the performance at different temperature extremes of a composite coil as the amount of Alloy 30 is varied.

DESCRIPTION

More particular reference to the drawing will disclose that a composite electromagnetic coil 10 constructed in accordance with the present invention may include concentric inner and outer windings 11 and 12, respectively. It has been discovered that an advantage can be secured by using a composite coil of copper wire and an alloy wire with higher specific resistance/lower temperature coefficient than copper. Such advantage is a substantial reduction in change from hot to cold wattage with minimal impact on electromagnetic performance for the same envelope (package size) and weight. A further discovery is that a maximum benefit can be secured by limiting the quantity of alloy wire used to a predetermined ratio of the copper wire employed. If more or less alloy wire is used, the resulting coil will have decided disadvantages.

The drawing discloses a coil having the optimum relative physical dimensions for most satisfactory operation. As shown, a coil with an outside diameter of one unit and an inside diameter of 0.4 of one unit should have an inner copper wire winding 11 with an outside diameter of 0.7 of one unit, and an outer winding 12 composed of the selected alloy wire to complete the coil. The alloy wire should be between 1- and 2-gage sizes smaller than the copper wire and electrically connected thereto, the direction of winding being the same to give the outer winding a magnetic aiding relationship with the inner winding.

One might think from the teachings of the references, Weston in particular, that an electromagnetic coil could be constructed entirely of an alloy with the same specific resistance as copper. Such thinking is incorrect, however, because the resulting coil would be impractical, as shown by the drawing and following discussion. The chart of FIG. 4 shows that at practical coil operating temperatures a coil constructed entirely of an alloy (designated Alloy 30) with a specific resistance of 30 ohms/cmf, compared to 10.37 of copper at a wire temperature of 68° F, would, at 480° F, have about 71% of the NI (ampere turns) of an all copper coil of equal physical dimensions operating on the same voltage and dissipating the same wattage (equal coil resistance at 480° F). The chart shown in FIG. 4 illustrates the relationships between Alloy 30 and copper at temperature extremes of 480° F and −65° F.

In order to fit the wire in the same space, the product of wire sectional area and turns must be equal for both coils. Since the Alloy 30 wire has 1.41 times the sectional area of copper wire but two times the specific resistance at 480° F, the resistance per turn is 2/1.41 = 1.41 times the resistance of the copper coil wire. Since there are fewer Alloy 30 turns, the total resistance of both is equal (at 480° F) and the wattage dissipation is equal for a specified applied voltage. If a larger section area Alloy 30 wire were used, the resistance per turn would be lower and the number of turns would be fewer. Total coil resistance would be less and wattage dissipation would exceed the design limits. If a smaller area Alloy 30 wire were used (for example, the same size as the copper wire) the number of turns is the same as the copper coil, but the resistance per turn doubles, the total resistance doubles, the current at the specified voltage is one half, and the ampere turn output is reduced to 50% of the copper coil performance.

By constructing a composite coil structure with Alloy 30 in combination with copper wire an unexpected and useful result occurs.

As shown in FIG. 2 and defined previously, relative physical dimensions have been assigned to a coil structure for quantitative descriptive purposes. FIG. 5 shows the relationships of the composite coil when half of the section area is Alloy 30 and half is copper.

FIG. 6 shows why Alloy 30 coils are unattractive. Wattage at −65° F is reduced by 45% over an equivalent copper coil, but hot NI at 480° F is down approximately 29% compared to an equivalent copper coil. The composite coil with 50% Alloy 30 and 50% copper has improved performance but still represents a significant loss in hot NI.

FIGS. 7 and 8 show the performance of a composite coil as the amount of Alloy 30 is varied based on the relative physical dimensions of FIG. 2 and the wire sizes shown in FIG. 4. At about 23% Alloy 30, the composite coil will produce 6% less hot NI than an all copper coil at 480° F and draw 20% less wattage than an all copper coil at −65° F. Such a coil delivers the most desirable results and best meets the objectives set forth previously. It will be noted from FIG. 2 that the thickness of the outer winding 12 is between 20% to 30% of the thickness of both windings or the total coil.

While the description refers only to one alloy, it should be obvious that other alloys having qualities similar to such alloy could be employed without departing from the spirit and scope of this invention.

I claim:

1. An electromagnetic coil useful over a widely varying range of temperatures which draws relatively low wattage at low temperatures and provides relatively high ampere turn output at high temperatures, comprising:

a. a first winding of a wire having a first positive value temperature coefficient of resistance; and b. a second winding of a wire having a second positive value temperature coefficient of resistance less than the first positive value temperature coefficient of the wire of the first winding, the second winding being arranged in magnetic aiding relationship with said first winding and bearing a predetermined thickness ratio thereto.

2. The electromagnetic coil of claim 1 in which the wire of the first winding is copper and the wire of the second winding is copper contaminated with a minor percentage of nickel.

3. The electromagnetic coil of claim 1 in which the windings are concentric.

4. The electromagnetic coil of claim 3 in which the wire of the outermost winding is composed of copper contaminated with a minor percentage of nickel.

5. The electromagnetic coil of claim 2 in which the quantity of nickel in the wire of the second winding is approximately 2% of the total of copper and nickel in such wire.

6. The electromagnetic coil of claim 1 in which the wire of the second winding is of a smaller gage than that of the first winding.

7. The electromagnetic coil of claim 1 in which the ratio of the thickness of the second winding relative to that of both windings is between 20% and 30%.

8. The electromagnetic coil of claim 4 in which the ratio of the thickness of the outermost winding relative to that of both windings is between 20% and 30%.

9. An electromagnetic coil useful over a widely varying range of temperatures, comprising:

an inner winding of copper having a first positive value temperature coefficient of resistance; and an outer winding concentrically arranged in magnetic aiding relationship around said inner winding, said outer winding being of copper contaminated with a minor percentage of nickel whereby said outer winding has a second positive value temperature coefficient of resistance which is less than the first positive value temperature coefficient of the inner winding, the quantity of nickel in said outer winding being approximately 2% of the total of copper and nickel in said outer winding, said outer winding having a substantially smaller gage than said inner winding, the thickness of said outer winding being approximately 20% of the total combined thickness of both said inner and outer windings, whereby said coil draws relatively low wattage at low temperatures and provides high ampere turn output at high temperatures.

* * * * *

UNITED STATES PATENT AND TRADEMARK OFFICE

CERTIFICATE OF CORRECTION

PATENT NO. : 3,992,690

DATED : November 16, 1976

INVENTOR(S) : CHARLES J. SPERR, JR.

It is certified that error appears in the above-identified patent and that said Letters Patent are hereby corrected as shown below:

Column 1, in each of lines 12, 13, 14, delete "Re."

Signed and Sealed this

Seventeenth Day of May 1977

[SEAL]

*Attest:*

RUTH C. MASON
*Attesting Officer*

C. MARSHALL DANN
*Commissioner of Patents and Trademarks*